US009290252B1

(12) United States Patent
Tuchscherer et al.

(10) Patent No.: US 9,290,252 B1
(45) Date of Patent: Mar. 22, 2016

(54) SYSTEMS AND METHODS FOR CONTROLLING TRIM POSITION OF A MARINE PROPULSION DEVICE ON A MARINE VESSEL

(71) Applicant: Brunswick Corporation, Lake Forest, IL (US)

(72) Inventors: Andrew Tuchscherer, Wauwatosa, WI (US); John A. Groeschel, Theresa, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/594,228

(22) Filed: Jan. 12, 2015

(51) Int. Cl.
*B63H 20/10* (2006.01)
*B63H 20/06* (2006.01)

(52) U.S. Cl.
CPC ..... *B63H 20/10* (2013.01); *B63H 20/06* (2013.01)

(58) Field of Classification Search
CPC ..... B63H 20/06; B63H 20/08; B63H 20/10; B63H 20/12; B63H 5/125; B63H 21/21; B63H 21/22
USPC ..... 440/1, 61 T
See application file for complete search history.

(56) References Cited

U.S. PATENT DOCUMENTS 4,050,359 A 9/1977 Mayer
4,872,857 A 10/1989 Newman et al.
4,893,800 A 1/1990 Tabata
5,707,263 A 1/1998 Eick et al.
5,977,678 A * 11/1999 Miller ..... B60S 1/342 15/250.34
5,996,745 A 12/1999 Jones, Jr. et al.
6,176,170 B1 1/2001 Uppgard et al.
6,183,321 B1 2/2001 Alby et al.
(Continued)

FOREIGN PATENT DOCUMENTS

EP 1 803 961 2/2011
EP 2 113 681 10/2011
WO 96/33356 10/1996

OTHER PUBLICATIONS

U.S. Appl. No. 13/688,109, filed Nov. 28, 2012.
(Continued)

*Primary Examiner* — Lars A Olson
(74) *Attorney, Agent, or Firm* — Andrus Intellectual Property Law, LLP

(57) ABSTRACT

Systems and methods are for controlling trim position of a marine propulsion device on a marine vessel. The system comprises a trim actuator having a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitates movement of the trim actuator into and out of the extended and retracted positions. A controller is configured to adapt the amount of voltage to the electromagnet based upon at least one condition of the system.

24 Claims, 9 Drawing Sheets

(56) References Cited

U.S. PATENT DOCUMENTS

| | | | | |
|---|---|---|---|---|
| 6,273,771 | B1 | 8/2001 | Buckley et al. | |
| 6,322,404 | B1 | 11/2001 | Magee et al. | |
| 6,325,331 | B1 * | 12/2001 | McKeown | B64C 13/08 244/220 |
| 6,419,534 | B1 | 7/2002 | Helsel et al. | |
| 6,830,492 | B1 | 12/2004 | Magee et al. | |
| 6,929,518 | B1 | 8/2005 | Sawyer et al. | |
| 6,942,530 | B1 | 9/2005 | Hall et al. | |
| 7,156,709 | B1 | 1/2007 | Staerzl et al. | |
| 7,244,152 | B1 | 7/2007 | Uppgard | |
| 7,896,304 | B1 | 3/2011 | Eichinger et al. | |
| 7,942,711 | B1 | 5/2011 | Swan | |
| 8,113,892 | B1 | 2/2012 | Gable et al. | |
| 2009/0276098 | A1 | 11/2009 | Bodie et al. | |

OTHER PUBLICATIONS

U.S. Appl. No. 14/573,347, filed Dec. 17, 2014.

* cited by examiner

SYSTEMS AND METHODS FOR CONTROLLING TRIM POSITION OF A MARINE PROPULSION DEVICE ON A MARINE VESSEL

FIELD

The present disclosure relates to propulsion systems for marine vessels and more particularly to systems and methods for controlling trim position of a marine propulsion device on a marine vessel.

BACKGROUND

The following U.S. Patents and U.S. Patent Application are incorporated herein by reference in entirety:

U.S. patent application Ser. No. 14/573,347, filed Dec. 17, 2014, discloses systems and methods for supporting a propulsion device with respect to a marine vessel. An elastic mount supports the propulsion device with respect to the marine vessel. Increasing an amount of voltage to an electromagnet increases the shear strength of a magnetic fluid in the mount thereby decreasing elasticity of the mount. Decreasing the amount of voltage to the electromagnet decreases the shear strength of the magnetic fluid thereby increasing the elasticity of the mount. A controller adapts the amount of voltage based upon at least one condition of the system.

U.S. Pat. No. 8,113,892 discloses a marine propulsion control system that receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 7,942,711 discloses a method for controlling a marine propulsion trim system under two distinct modes of operation. A first mode operates hydraulic cylinders at a slower speed when the associated marine vessel is being operated at a speed above a predetermined threshold. For example, when the marine propulsion device is under load, such as when the marine vessel is operating on plane, the first mode of operation is used and the trim/tilt cylinders are operated at a slower speed. A second mode of operation is used when the marine propulsion system is being operated below a predetermined threshold. In other words, if the marine vessel is operating at a slow speed, the faster mode of operation is used. Similarly, if the marine vessel is being prepared for transport on a trailer, the very slow or non-existent speed of operation of the engine is used as an indicator which causes the second mode of operation to be employed.

U.S. Pat. No. 7,156,709 discloses a calibration procedure that allows an upward maximum limit of tilt to be automatically determined and stored as an operator rotates a marine propulsion device relative to a marine vessel with a particular indication present. That indication can be a grounded circuit point which informs a microprocessor that at calibration procedure is occurring in relation to an upward trim limit. When the ground wire is removed or disconnected from the circuit point, the microprocessor knows that the calibration process is complete. During the rotation of the outboard motor or marine propulsion device in an upward direction, both the angular position of the outboard motor and the direction of change of a signal from a trim sensor are stored.

U.S. Pat. No. 6,942,530 discloses an engine control strategy for a marine propulsion system that selects a desired idle speed for use during a shift event based on boat speed and engine temperature. In order to change the engine operating speed to the desired idle speed during the shift event, ignition timing is altered and the status of an idle air control valve is changed. These changes to the ignition timing and the idle air control valve are made in order to achieve the desired engine idle speed during the shift event. The idle speed during the shift event is selected so that the impact shock and resulting noise of the shift event can be decreased without causing the engine to stall.

U.S. Pat. No. 6,929,518 discloses a shifting apparatus for a marine propulsion device that incorporates a magnetoelastic elastic sensor which responds to torque exerted on the shift shaft of the gear shift mechanism. The torque on the shift shaft induces stress which changes the magnetic characteristics of the shift shaft material and, in turn, allows the magnetoelastic sensor to provide appropriate output signals representative of the torque exerted on the shift shaft. This allows a microprocessor to respond to the onset of a shifting procedure rather than having to wait for actual physical movement of the components of the shifting device.

U.S. Pat. No. 6,830,492 discloses a two stage damping system for a trim cylinder mount of a marine drive unit. The mounting bushings comprise inner and outer tubes with an elastomeric material disposed between the inner and outer tubes. The elastomeric material is structured to provide a soft rate of stiffness in response to relatively light loads, such as shifting loads, and a harder rate of stiffness in response to higher loads, such as during high thrust loads or wide open throttle operation of a marine vessel. The two rates of stiffness are provided by the appropriate placement of cavities either within the elastomeric material or between the elastomeric material and the inner or outer tubes. Alternatively, two different types of elastomeric material can be used to provide the two rates of stiffness.

U.S. Pat. No. 6,322,404 discloses a Hall Effect rotational position sensor mounted on a pivotable member of a marine propulsion system. A rotatable portion of the rotational position sensor is attached to a drive structure of the marine propulsion system. Relative movement between the pivotable member, such as a gimbal ring, and the drive structure, such as the outboard drive portion of the marine propulsion system, cause relative movement between the rotatable and stationary portions of the rotational position sensor. As a result, signals can be provided which are representative of the angular position between the drive structure and the pivotable member.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,183,321 discloses an outboard motor having a pedestal that is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 5,707,263 discloses a system for a trimmable marine stem drive that shifts the trimmable range on a conventional hydraulic trim system. The system includes an enlarged cylinder anchor pin hole in the drive shaft housing, an anchor pin smaller in size than the enlarged anchor pin hole located in the drive shaft housing, and a movable trim adjustment insert that is inserted into the enlarged anchor pin hole to secure the anchor pin in a fixed position within the enlarged hole. It is preferred that the enlarged anchor pin hole be a substantially horizontal elongated hole, and that the trim adjustment insert be placed rearward of the anchor pin to position the anchor pin in a forward position, or forward of the anchor pin to locate the anchor pin in a rearward position. The invention shifts the trimmable range of the drive, while maintaining vibration isolation characteristics available in conventional hydraulic trim systems.

U.S. Pat. No. 4,893,800 discloses a power unit mount that includes a housing in which first and second electrode bodies are suspended and which is filled with a fluid which exhibits a change in viscosity when a voltage is applied there across. The control of the voltage application is determined by a control circuit which is operatively connected to a plurality of sensors which include an engine speed sensor, a road wheel speed sensor, a relative displacement sensor and an absolute displacement sensor. A variant includes a solenoid powered vibration generator which can be energized under predetermined conditions in a manner to improve vibration attenuation.

U.S. Pat. No. 4,872,857 discloses a system for optimizing the operation of a marine drive of the type whose position may be varied with respect to the boat by the operation of separate lift. Trim/tilt means includes an automatic control system which stores preselected drive unit positions for various operating modes and is operative to return the drive unit to any pre-established position by pressing a selected operating mode positioning button. The various operating modes may include cruising, acceleration, trolling and trailering position, any of which may be selectively modified to accommodate changes in both operating or environmental conditions. This system may incorporate other optimization routines and/or automatic engine protection systems to provide virtually complete push button operation for complex marine drive unit positioning mechanisms.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

Systems and methods are for controlling trim position of a marine propulsion device on a marine vessel. The systems can comprise a trim actuator having a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions. Decreasing the amount of voltage to the electromagnet decreases the shear strength of the magnetic fluid thereby facilitating easier movement of the trim actuator into and out of the extended and retracted positions. A controller is configured to adapt the amount of voltage to the electromagnet based upon at least one condition of the system.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Through research and development, the present inventors found that current trim systems are limited because although increased resiliency is desirable when the marine propulsion system is operated in forward gear, to allow trail over for example during log-strike situations, decreased resiliency is desirable when the marine propulsion system is operated in reverse gear to allow for increased reverse thrust capability. The present inventors have also endeavored to provide a marine propulsion system for vessels having improved noise, vibration and harshness characteristics. The present inventors have endeavored to provide a marine propulsion system having increased power, speed, and acceleration and tighter transom packaging. Through such research and development, the present inventors found that current trim systems have limitations that force engineering compromises regarding overall package size, layout, engine design, and noise, vibration and harshness characteristics. Also, the inventors found that prior art trim systems typically are only designed for an entire family of propulsion devices having similar characteristics and typically are not adjustable or vessel-specific. During the above noted research and development, the present inventors determined that it would be desirable to provide systems and methods that semi-actively and/or actively adapt the ease at which the trim system reacts to over pressure situations based upon current characteristics and/or conditions of the marine propulsion device to thereby actively and/or semi-actively control displacement of the propulsion device during marine vessel travel, and particularly during over pressure events.

Figure 2:
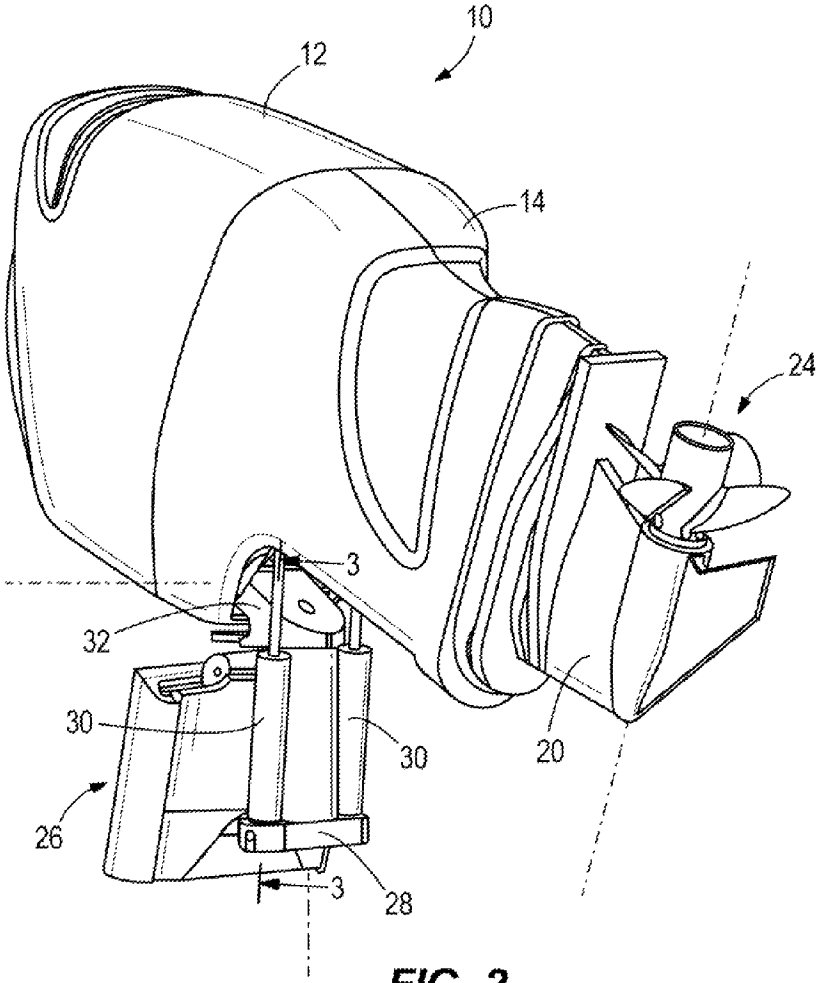
FIG. 2 is a rear perspective view of an outboard motor in a trimmed up position.
Figure 1:
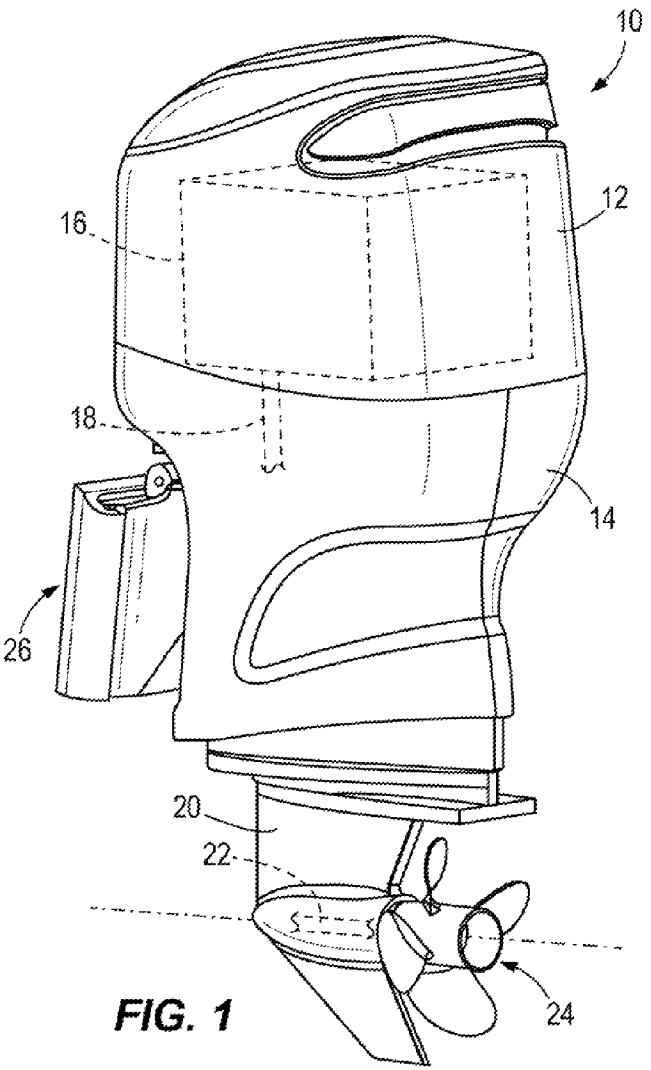
FIG. 1 is a rear perspective view of an outboard marine engine in a trimmed down position.

FIGS. 1 and 2 are taken from the incorporated U.S. Pat. No. 6,183,321 and depict a marine propulsion device 10, which in this example an outboard motor. The exact configuration of the marine propulsion device 10 can vary from the example shown. In this example, the marine propulsion device 10 has an upper cowl 12, a lower cowl 14 disposed below the upper cowl 12, and a gearcase housing 20 disposed below the lower cowl 14. An internal combustion engine, which is schematically shown at 16, is disposed within the upper cowl 12. A driveshaft 18 extends downward from the internal combustion engine 16, through the lower cowl 14, towards the gearcase housing 20. The driveshaft 18 is directly or indirectly connected to a propulsor shaft 22 located in the gearcase housing 20, such that rotation of the driveshaft 18 causes rotation of the propulsor shaft 22, which in turn causes rotation of a propulsor 24. In this example, the propulsor 24 is a propeller, however the type of propulsor 24 can vary and in other examples can include one or more propellers and/or impellers and/or the like.

The marine propulsion device 10 is configured for connection to a marine vessel, and in this example more specifically to the transom of the marine vessel. A mounting pedestal 26 retains the marine propulsion device 10 with respect to the marine vessel. The pedestal 26 is a known apparatus and is fully described in the incorporated U.S. Pat. No. 6,183,321. The pedestal 26 can be combined with a transom bracket according to conventional arrangements.

As shown in FIG. 2, a trim actuator 28 is connected to the pedestal 26. The trim actuator 28 is a hydraulically-operated device that receives pressurized magnetic fluid from a source of such magnetic fluid. The exact configuration of the trim actuator 28 can vary. In this example, the trim actuator 28 includes a pair of piston-cylinders 30 and a pedestal tube 32 disposed between the pair of piston-cylinders 30. The pedestal tube 32 contains an electric motor (not shown) for conveying magnetic fluid from a source of magnetic fluid 101 to the piston-cylinders 30. The configuration and operation of the pedestal tube 32 and associated motor is conventional and is more particularly disclosed in the incorporated U.S. Pat. No. 6,183,321. Thus, the pedestal tube 32 and its manner of operation are not further described herein for brevity sake. The pair of piston-cylinders 30 are the same as each other and thus the following description focuses on only one of the piston-cylinders. That is, the following description equally applies to both of the piston-cylinders 30.

Figure 3:
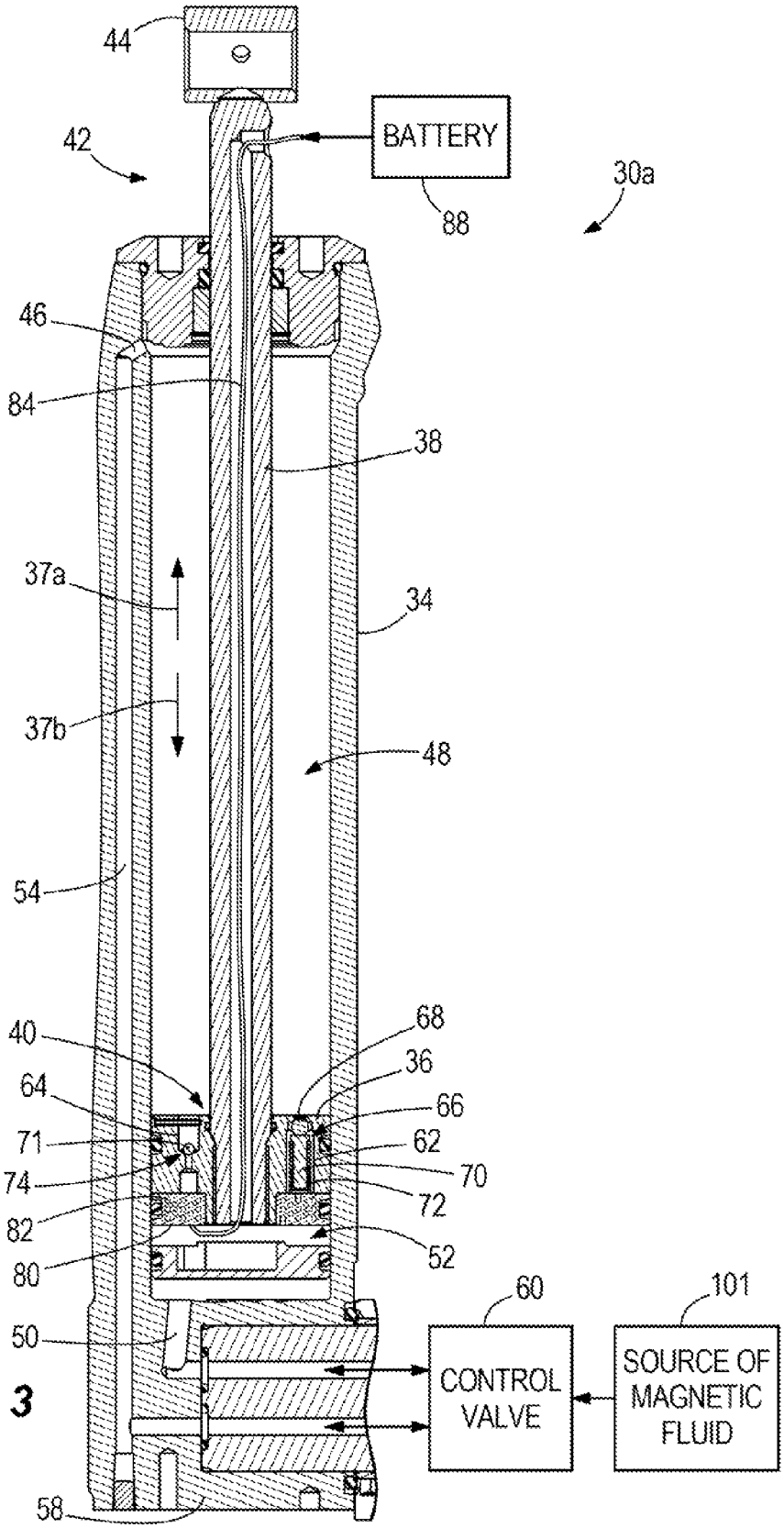
FIG. 3 is one exemplary view of section 3-3 taken in FIG. 2.
Figure 4:
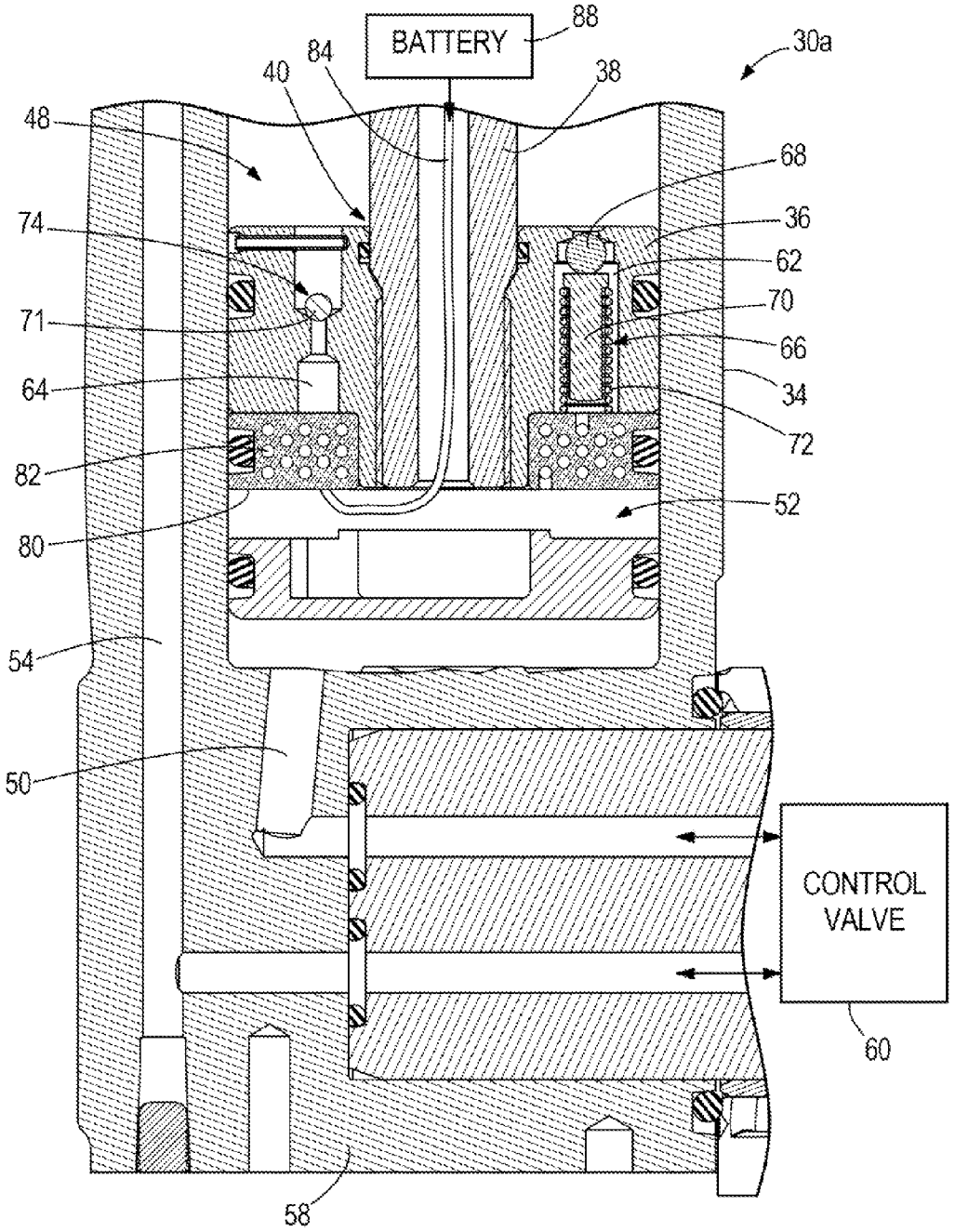
FIG. 4 is a closer view of the example shown in FIG. 3.

FIGS. 3 and 4 depict one example of a piston-cylinder 30*a* according to the present disclosure. The piston-cylinder 30*a* includes a cylinder 34 and a piston 36 that reciprocates back and forth in the cylinder 34, as shown at arrows 37*a*, 37*b*. A piston rod 38 is coupled to the piston 36 and extends from one end of the cylinder 34. The piston rod 38 has a first end 40 that is connected to the piston 36 and a second end 42 that extends from the cylinder 34. A rod end 44 is disposed on the second end 42 and is configured for connection to the marine propulsion device 10. Movement of the piston 36 in the direction of arrow 37*a* causes the piston rod 38 to further extend from the cylinder 34 and thus raises the marine propulsion device 10 into a trimmed up position, one example of which is shown in FIG. 2. Movement of the piston 36 in the direction of arrow 37*b* causes the piston rod 38 to retract into the cylinder 34 and thus lowers the marine propulsion device 10 into the trimmed down position shown in FIG. 1. Similar to the piston-cylinders disclosed in the incorporated U.S. Pat. No. 6,183,321, the piston-cylinder 30*a* has a first inlet 46 to the cylinder 34 on a rod side 48 of the piston 36. The piston-cylinder 30*a* also has a second inlet 50 to the cylinder 34 on a cylinder side 52 of the piston 36. The first inlet 46 extends from one end of the piston-cylinder 30*a* to the opposite end of the piston-cylinder 30*a* via an axial passageway 54 in the sidewall 56 of the cylinder 34. The second inlet 50 axially extends through the end cap 58 of the cylinder 34 to the noted cylinder side 52 of the cylinder 34.

A control valve, shown here schematically at 60 controls flow of the magnetic fluid to the rod side 48 of the piston 36 and the cylinder side 52 of the piston 36 via the noted first and second inlets 46, 50, respectively. The control valve 60 is a conventional feature, which is more fully described in the incorporated U.S. Pat. No. 6,183,321. Flow of the magnetic fluid to the rod side 48 of the piston 36 causes the piston 36 to move in the direction of arrow 37*b* such that the piston rod 38 further retracts into the cylinder 34 and the marine propulsion device 10 is trimmed downwardly. Flow of magnetic fluid to the cylinder side 52 of the piston 36 causes the piston 36 to move in the direction of arrow 37*a* such that the piston rod 38 further extends from the cylinder 34 and the marine propulsion device 10 is trimmed upwardly.

The piston 36 includes passages that allow flow of the magnetic fluid past the piston 36 during over pressure events, such as for example during an impact to the marine propulsion device 10 or any other large force on the marine propulsion device 10, such as a thrust load and/or the like. The passages allow flow past the piston 36 as the piston 36 moves in the direction of arrows 37*a*, 37*b*, i.e. as the trim actuator 28 moves into and out of the retracted and extended positions shown in FIGS. 1 and 2. A first passage 62 conveys the magnetic fluid from the rod side 48 of the piston 36 to the cylinder side 52 of the piston 36. A second passage 64 conveys the magnetic fluid from the cylinder side 52 of the piston 36 to the rod side 48 of the piston 36. Each of the first and second passages 62, 64 has a valve arrangement therein for controlling flow of the magnetic fluid through the first and second passages 62, 64. The type and configuration of each valve arrangement can vary from that which is shown and described. In this example, a first check valve 66 is disposed in the first passage 62. The first check valve 66 includes a ball 68 that is biased into a seated closed position (as shown in FIGS. 3 and 4) by a plunger 70 and spring 72. During an over pressure event in an aftward direction on the marine propulsion device 10, the magnetic fluid on the rod side of the piston 36 can develop a pressure that is larger than a bias force of the spring 72, and thus the ball 68 is moved to an open position wherein the ball 68 is separated from its seat and flow of magnetic fluid from the rod side 48 of the piston 36 to the cylinder side 52 of the piston 36 is permitted. Conversely, when the magnetic fluid on the rod side 48 of the piston 36 develops a pressure that is smaller than the bias force of the spring 72, the ball 68 is biased by the spring 72 into the closed position shown in FIG. 4, wherein the ball 68 is seated and flow of magnetic fluid from the rod side 48 of the piston 36 to the cylinder side 52 of the piston 36 is prevented.

A second check valve 74 is disposed in the second passage 64. The second check valve 74 includes a ball 71 that is biased into a seated, closed position (shown in FIGS. 3 and 4) by the pressure of the magnetic fluid on the rod side 48 of the piston 36. During an over pressure event in a forward direction on the marine propulsion device 10, the magnetic fluid on the cylinder side 52 of the piston 36 develops a pressure that is greater than the pressure of the magnetic fluid on the rod side 48 of the piston 36, and thus the ball 71 is biased into an unseated, open position wherein the ball 71 is separated from its seat and flow of magnetic fluid from the cylinder side 52 of the piston 36 to the rod side 48 of the piston 36 is permitted. Conversely, when the magnetic fluid on the cylinder side 52 of the piston 36 has a pressure that is less than the pressure of the magnetic fluid on the rod side 48 of the piston 36, the ball 71 is biased into the seated, closed position shown in FIG. 4, wherein flow of magnetic fluid from the cylinder side 52 of the piston 36 to the rod side 48 of the piston 36 is permitted.

An electromagnet 80 is connected to the piston 36. The electromagnet 80 includes a plurality of passages 82 through which the magnetic fluid can flow during an over pressure event. The magnetic fluid flows past the piston 36 as the piston 36 moves in the direction of arrows 37*a*, 37*b*. In certain examples, the holes 82 can form a circuitous path through the electromagnet 80. In other examples, the holes 82 form a straight line path. An control cable 84 is connected to the electromagnet 80 and extends through a passage 86 in the piston rod 38. The control cable 84 connects a source of voltage 88, which in this example is a battery, to the electromagnet 80.

Application of a voltage to the electromagnet to generate a magnetic field on a magnetic fluid to alter damping characteristics is described, for example, in U.S. Pat. No. 4,893,800. Changing the amount of voltage applied to the electromagnet 80 in the piston-cylinder 30*a* changes the damping characteristics of the piston-cylinder 30*a*. More specifically, increasing the amount of voltage to the electromagnet 80 increases the magnetic field produced by the electromagnet 80, which magnetizes the magnetic fluid as it flows through the passages 62, 64. Magnetizing the magnetic fluid increases its shear strength, thus providing increased resistance to its flow through the passages 62, 64. That is, as the amount of voltage applied to the electromagnet 80 is increased, it becomes more difficult for the piston 36 to reciprocate due to increased shear strength of the magnetic fluid. Movement of the trip actuator 28 into and out of the extended and retracted position is restricted. In contrast, decreasing the amount of voltage to the electromagnet 80 decreases the shear strength of the magnetic fluid, thereby easing its flow through the passages 62, 64. This facilitates easier reciprocal movement of the piston 36 and thus increases the elasticity of the piston-cylinder 30*a*.

Figure 5:
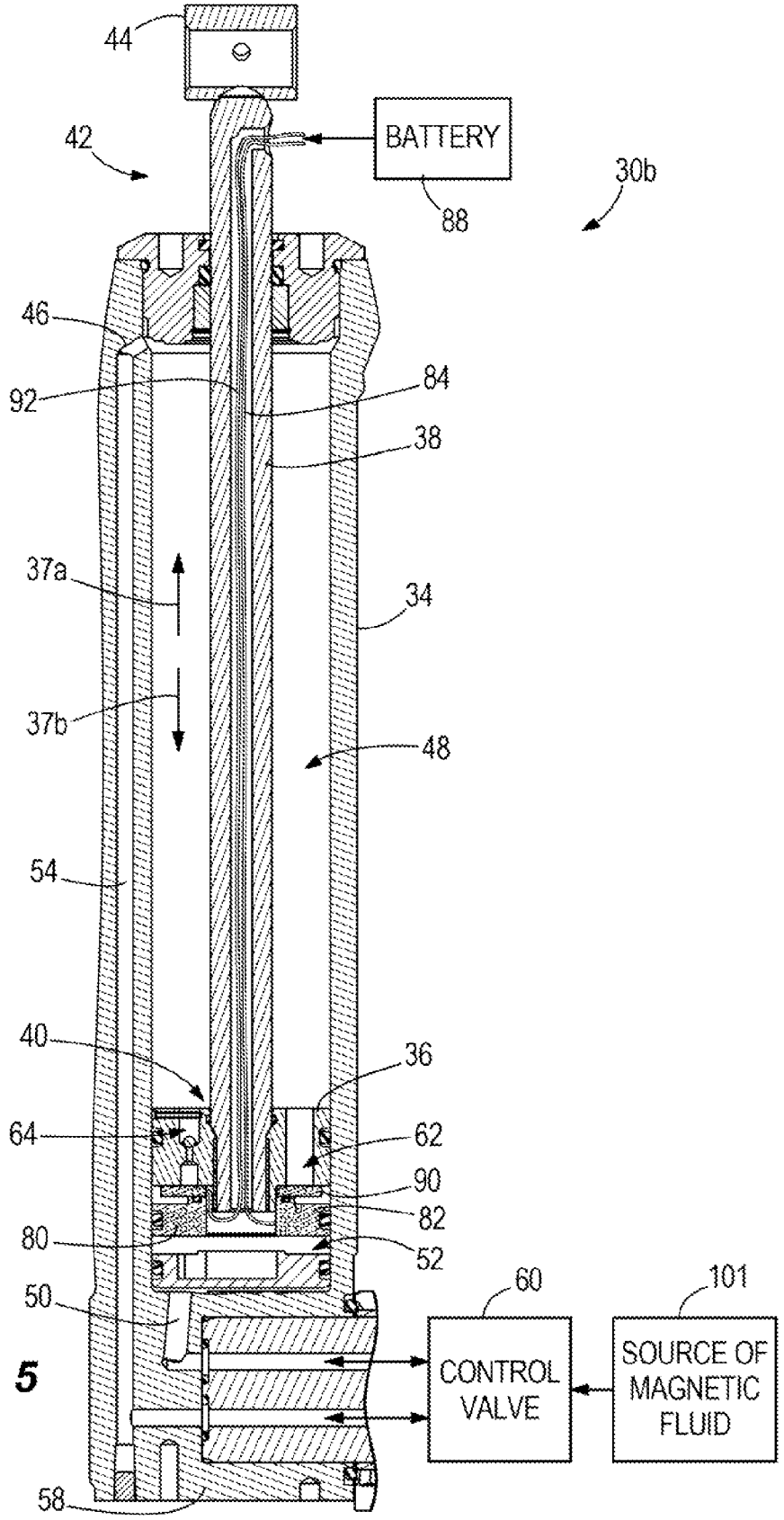
FIG. 5 is a second exemplary view of section 3-3 taken in FIG. 2.
Figure 6:
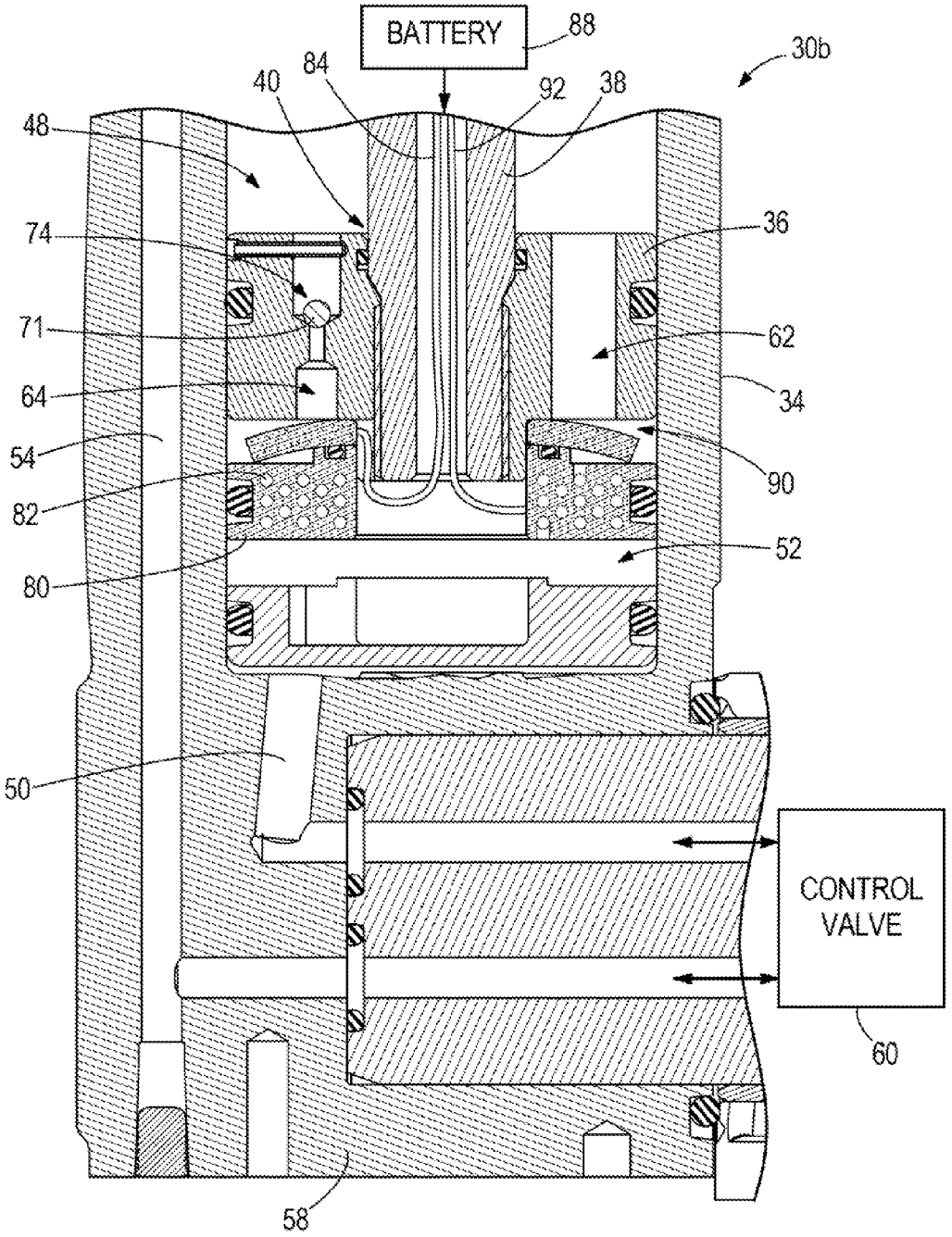
FIG. 6 is a closer view of the example shown in FIG. 5.

FIGS. 5 and 6 depict another example of a piston-cylinder 30*b*. The piston-cylinder 30*b* is identical to the piston-cylinder 30*a* except for the configuration of the check valve associated with the piston 36. In this example, instead of having the first check valve 66 disposed in the first passage 62, a piezo-electric valve 90 is attached to the electromagnet 80 on the cylinder side 52 of the piston 36. A second control cable 92 extends through the passage 86 to the piezo-electric valve 90. The second control cable 92 receives power from a power source, such as the noted battery 88. Supplying electrical power to the piezo-electric valve 90 causes the piezo-electric valve 90 to curl, as shown in FIG. 6, thus opening the noted first and second passages 62, 64 and allowing flow of magnetic fluid through the first passage 62, as described herein above.

Figure 7:
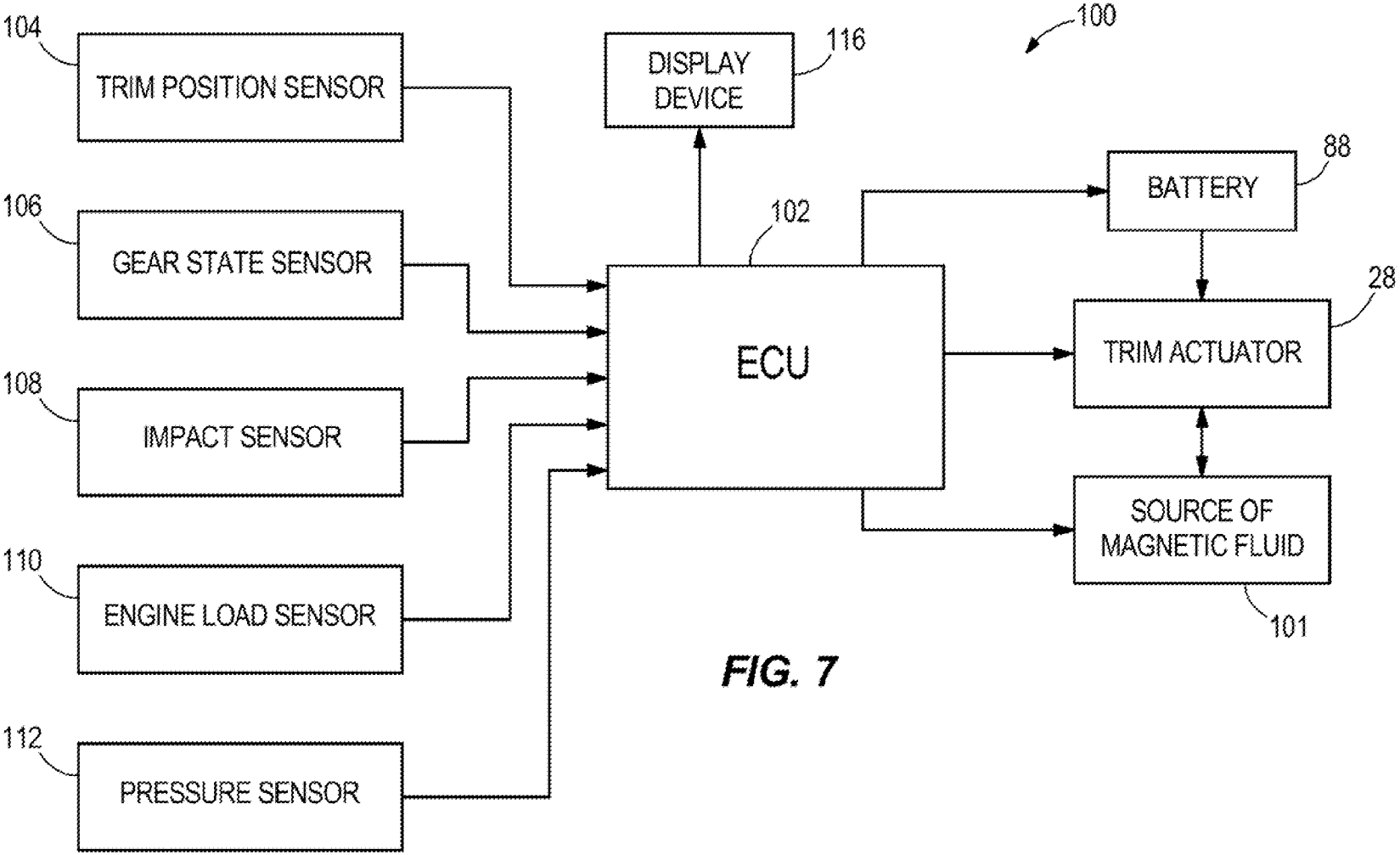
FIG. 7 is a schematic view of an exemplary system for controlling the trim of the outboard marine engine.

FIG. 7 depicts one example of a system 100 for controlling trim position of the marine propulsion device 10 using at least one of the exemplary trim actuators described herein above. The system 100 includes the noted trim actuator 28, which can include the piston-cylinders 30*a* and/or 30*b* and/or another variant thereof. The system 100 also includes the noted power source (e.g. battery 88), which can provide voltage to the electromagnet 80 at the trim actuator 28. The system 100 also includes the source of pressurized magnetic fluid 101, which can include a motor for providing magnetic fluid to the piston-cylinders 30*a*, 30*b*, as described herein above.

The system 100 also includes a controller in the form of an engine control unit 102 that is programmable and includes a computer processor, software, memory (i.e. computer storage) and an associated input/output (interface) device. The processor loads and executes software, which can be stored in the memory. Executing the software controls the system 100 to operate as described herein in further detail below. The processor can comprise a microprocessor and/or other circuitry that receives and executes software. The processor can be implemented within a single device, but can also be distributed across multiple processing devices and/or subsystems that cooperate in executing program instructions. Examples include general purpose central processing units, application specific processors, and logic devices, as well as any other processing device, combination of processing devices, and/or variations thereof. The engine control unit 102 can be located anywhere with respect to the marine propulsion device 10 and associated marine vessel and can communicate with various components of the system 100 via wired and/or wireless links, examples of which are shown in FIG. 7. The engine control unit 102 can have one or more microprocessors that are located together or remotely from each other in the system 100 or remotely from the system 100.

The memory can include any storage media that is readable by the processor and capable of storing software. The memory can include volatile and/or non-volatile removable and or non-removable media implemented in any method or technology for storage of information, such as computer readable instructions, data structures, program modules, or other data. The memory can be implemented as a single storage device but may also be implemented across multiple storage devices or subsystems. The memory can further include additional elements such as a controller capable of communicating with the processor. Examples of storage media include random access memory, read only memory, magnetic discs, optical discs, flash memory discs, virtual and/or non-virtual, magnetic cassettes, magnetic tape, magnetic disc storage, or other magnetic storage devices, or any other medium which can be used to store the desired information that may be accessed by an instruction execution system, as well as any combination or variation thereof, or any other type of storage media. In some implementations, the storage media can be non-transitory storage media.

The input/output device can include any one of a variety of conventional computer input/output interfaces for receiving electrical signals for input to the processor and for sending electrical signals from the processor to various components of the system 100. The engine control unit 102, via the noted input/output device, communicates with components of the marine propulsion device 10 via communication links, which as mentioned herein above can be wired or wireless links. As explained further herein below, the engine control unit 102 is capable of monitoring and controlling operational characteristics of the marine propulsion device 10 by sending and/or receiving control signals via the various links shown in FIG. 7. Although the links are each shown as a single link, the term "link" can encompass one or a plurality of links that are each connected to one or more of the components of the system 100.

The engine control unit 102 can be programmed to control the control valve 60 to thereby adjust the trim position of the marine propulsion device 10. Upon input to the engine control unit 102 via for example a trim switch located at the helm of the marine vessel, the engine control unit 102 can actuate the control valve 60 to cause extension or retraction of the piston-cylinders 30, as described herein above. The engine control unit 102 can also be programmed to control the battery 88 to adjust the amount of voltage provided to the electromagnet 80. Further, the engine control unit 102 can be programmed to control the battery 88 to adjust the amount of voltage supplied to the valve 90 to open and close the noted first and second passages 62, 64.

The system 100 also includes various sensors that are configured to sense operational characteristics of the system 100 and convey such information in the form of electrical signals to the engine control unit 102. For example, a trim position sensor 104 is configured to sense a current trim position of the marine propulsion device 10 and provide this information to the engine control unit 102. The type of trim position sensor 104 can vary, in certain examples, the trim position sensor 104 includes a conventional encoder positioned along a trim axis of the marine propulsion device 10.

The system 100 can include a gear state sensor 106 that is configured to sense a current gear state (e.g. position) of a transmission associated with the marine propulsion device 10. In some examples, the gear state sensor 106 senses a current position of a shift linkage associated with a conventional shift/throttle lever. The gear state that is sensed by the gear state sensor 106 is communicated to the engine control unit 102. The type and location of gear state sensor 106 can vary. In some examples, the gear state sensor 106 includes a potentiometer and an electronic converter, such as an analog-to-digital converter that outputs discreet analog to digital (ADC) counts that each represents a position of the noted shift linkage. Such potentiometer and electronic converter combinations are known in the art and commercially available, for example, from CTS Corporation.

The system 100 can include an underwater impact sensor 108 that is configured to sense a future impact to the marine propulsion device 10 and communicate this information to the engine control unit 102. The type of underwater impact sensor 108 can vary and can include, for example, a conventional sonar system, laser system, and/or the like.

The system 100 can include an engine load sensor 110 that is configured to sense a current engine load of the marine propulsion device 10 and communicate this information to the engine control unit 102. The type of engine load sensor 110 can vary. In certain examples, the engine load sensor 110 is comprised of an engine speed sensor that is configured to sense a current engine speed of the marine propulsion device 10, in combination with a throttle valve position sensor that senses position of the throttle valve associated with the internal combustion engine 16 on the marine propulsion device 10. In certain examples, the engine speed sensor senses rotations per minute (RPM) of the internal combustion engine 16. The type and location of the engine speed sensor can vary and in some examples is a Hall Effect or variable reluctance sensor located near the encoder ring of the engine. Such an engine speed sensor is known in the art and commercially available, for example, from CTS Corporation or Delphi. The type and location of the throttle position sensor can vary. In some examples, the throttle position sensor is a wiper-type sensor, which can be located on the body of the noted throttle valve and is commercially available from Cooper Auto or Walbro. Engine load can be provided to the engine control unit 102 via comparison of the outputs of the noted throttle portion sensor and engine speed sensor.

The engine load can be related to the engine speed and with the input of the type of propulsor 24, a thrust map can be created and stored in the engine control unit 102. This can be utilized by the engine control unit 102 to drive a blow-off pressure profile for the trim actuator upon underwater strikes and reverse thrust lockout. The engine control unit 102 can be programmed to increase a factor of safety between the required blow-off pressure and abusive operation for rough water situations, to prevent the trim actuator 28 from prematurely releasing pressure.

The system 100 can include a pressure sensor 112 that is connected to each piston-cylinder 30 and configured to sense the pressure of the magnetic fluid in the piston-cylinder 30 and communicate this information to the engine control unit 102. The type and packaging of pressure sensor 112 can vary and in some examples includes a conventional pressure transducer.

Advantageously, the engine control unit 102 can be configured to adapt the flow of voltage from the battery 88 to the electromagnet 80 based upon at least one condition of the system, as sensed and provided to the engine control unit 102 by the above-noted sensors. In one example, the memory stores a map that correlates that noted one or more conditions of the system 100 to an amount of voltage to be provided to the electromagnet 80 from the battery 88. In addition or alternately, the memory can store a protocol that is followed by the engine control unit 102 to thereby adapt the amount of voltage. The engine control unit 102 is programmed to control the battery 88 to change the amount of voltage according to the map and/or other protocol stored in the memory.

The type of conditions upon which the engine control unit 102 adapts the amount of voltage can vary and in some examples, the engine control unit 102 can be programmed to adapt the amount of voltage based upon more than one condition. The conditions upon which the engine control unit 102 adapts the amount of voltage can include characteristics of the marine propulsion device 10 and/or the marine vessel to which the marine propulsion device 10 is connected. These conditions typically do not vary and can be calibrated in the engine control unit 102 during setup of the system 100. The conditions upon which the engine control unit 102 adapts the amount of voltage can include operational characteristics of the marine vessel, including speed, acceleration and/or the like. The engine control unit 102 can be configured to adapt the amount of voltage upon the occurrence of one or more of these types of operational characteristics (i.e. in real time) as further described herein below.

In certain examples, the condition of the system 100 upon which the engine control unit 102 adapts the amount of voltage includes the age of the noted trim actuator 28 and/or the piston-cylinders 30 associated with the trim actuator 28. Thus as the piston-cylinder 30 ages, the engine control unit 102 can be configured to adapt the shear strength of the magnetic fluid and maintain desired resiliency characteristics of the trim actuator 28.

In other examples, the condition of the system 100 can include the pressure of the magnetic fluid in the trim actuator 28, as sensed by the noted pressure sensor 112. For example, the engine control unit 102 can be configured to reduce the amount of voltage when the pressure of the magnetic fluid exceeds a pressure threshold, thus protecting the trim actuator 28 against a breakdown due to overpressure.

In other examples, the system 100 can include the above-noted engine speed sensor and the engine control unit 102 can be programmed with a calibration map that is developed for engine speed (e.g. rotations per minute) and a corresponding "blow-off" pressure profile for the trim actuator 28.

In certain examples, the condition of the system 100 can include the current gear state of the marine propulsion device 10. For example, the engine control unit 102 can be configured to reduce the amount of voltage if the current gear state is a forward gear, thus increasing elasticity facilitating easier trail over (pivoting of the marine propulsion device) during collision with underwater structures, such as logs or rocks. The engine control unit 102 can further be configured to increase the amount of voltage if the current gear state is reverse gear, thus promoting increased rigidity (i.e. decreasing elasticity) of the trim actuator 28 to better support large reverse thrust loads during reverse gear operation of the marine propulsion device 10. Gear position can be input into the engine control unit 102 so that the engine control unit 102 compares the gear position to the current engine load and speed. The system 100 can thus be configured to adjust the blow-off pressures depending upon the current gear state. Improvements to shift harshness and transmitted vibrations while in idle and low load/speed could be improved by allowing the trim to fluctuate position.

In certain examples, the condition of the system 100 can include the current trim position of the marine propulsion device 10, as sensed by the trim position sensor 104. For example, the engine control unit 102 can be configured to increase the amount of voltage when the current trim position of the marine propulsion device 10 exceeds a trim position threshold, thus providing increased rigidity of the trim actuator 28 during docking and/or transport of the marine vessel when the marine propulsion device 10 typically is fully trimmed up. When the marine propulsion device 10 is trimmed into a tilt range for trailering or at a dock for storage, the system 100 could be programmed to remain active or in other examples a normally closed valve can be installed to prevent leak down.

In certain examples, the condition of the system 100 can include a future impact to the marine propulsion device 10, as sense by the underwater impact sensor 108. The underwater impact sensor 108 is configured to sense an impending impact and communicate this information to the engine control unit 102. Based upon this information, the engine control unit 102 can be configured to reduce the amount of voltage to thereby allow increased elasticity of the trim actuator 28, which permits easier pivoting movement of the marine propulsion device 10, and thus limits damage thereto during collision with underwater structures such as logs, rocks and/or the like.

In certain examples, the condition of the system 100 can include a current engine load of the marine propulsion device 10, as sensed by the engine load sensor 110. In these examples, the engine load sensor 110 is configured to sense the current engine load of the marine propulsion device 10 and communicate this information to the engine control unit 102. The engine control unit 102 is configured to control the battery 88 to adapt the amount of voltage, based upon, for example, the noted map or other protocol saved in the memory. The engine control unit 102 thus advantageously can be calibrated to adjust the ride characteristics of the marine propulsion device 10 during translation of the marine vessel.

In other examples, the system 100 can include a steering angle sensor for sensing current steering angle of the marine propulsion device 10. Corresponding trim blow-off pressures could be modified by the engine control unit 102 on a per cylinder basis.

In certain examples, the condition of the system 100 can include the current engine speed of the marine propulsion device 10, as sensed by the noted engine speed sensor. The engine speed sensor is configured to sense the current engine speed of the marine propulsion device 10 and communicate this information to the engine control unit 102, which in turn is configured to control the battery 88 based upon, for example a protocol saved in the memory or the map stored in the memory. In some examples the engine control unit 102 can be programmed to decrease the amount of voltage when the current engine speed is below an engine speed threshold. In certain examples, the engine control unit 102 can be configured to increase the amount of voltage when the current engine speed is above an engine speed threshold.

The system 100 can include a display device 116. The engine control unit 102 can be configured to control the display device 116 to display a condition of the trim actuator 28 to an operator. In certain examples, the engine control unit 102 can be programmed to provide recommended inspection or service action items to the operator based upon age of the trim actuator 28 or for example an underwater collision with marine propulsion device 10, as sensed by the above noted sensors.

Figure 8:
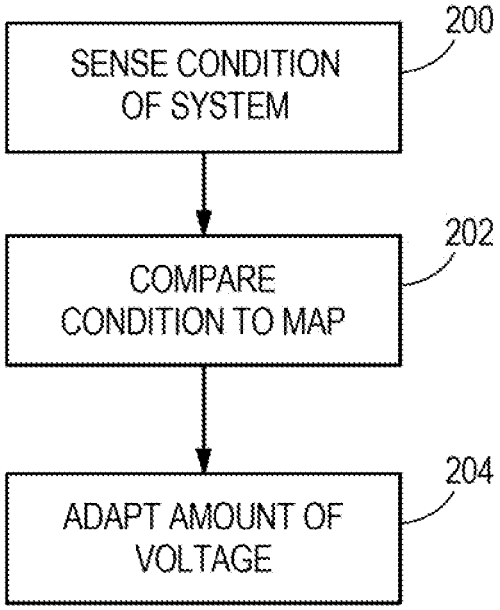
FIGS. 8-12 are flow charts showing exemplary method steps according to the present disclosure.

As shown in FIG. 8, at step 200, one or more of the above noted sensors is configured to sense one or more conditions of the system 100 and communicate this information to the engine control unit 102. At step 202, the engine control unit 102 is configured to compare the sensed condition(s) to the map or to another protocol stored in the memory. At step 204, the engine control unit 102 is configured to adapt the amount of voltage that is applied by the battery 88 to the electromagnet 80.

Figure 9:
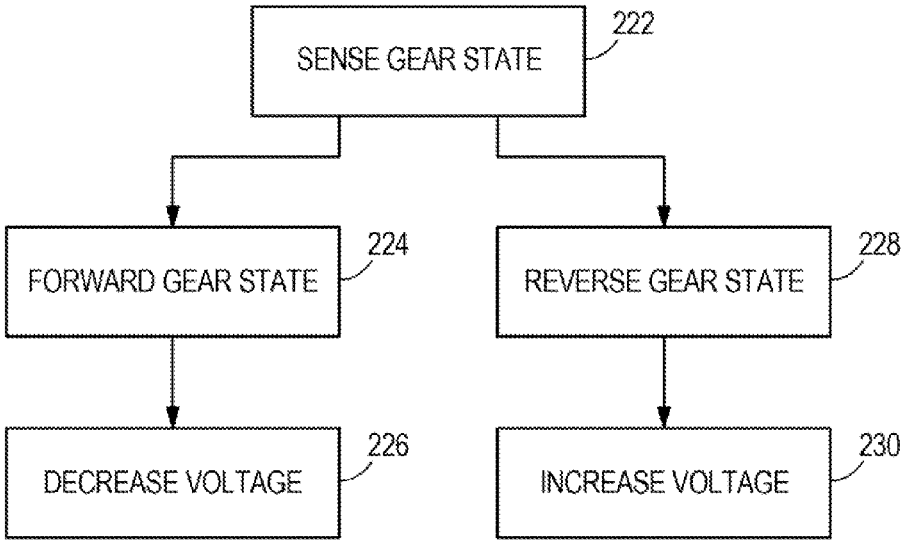

FIG. 9 depicts an example wherein, at step 222, the gear state sensor 106 senses the current gear state of the marine propulsion device 10. When the forward gear state is sensed, at step 224, the engine control unit 102 is configured at step 226 to decrease the amount of voltage. When at step 228, the reverse gear state is sensed and the engine control unit 102 is configured, at step 230, to increase the amount of voltage.

Figure 10:
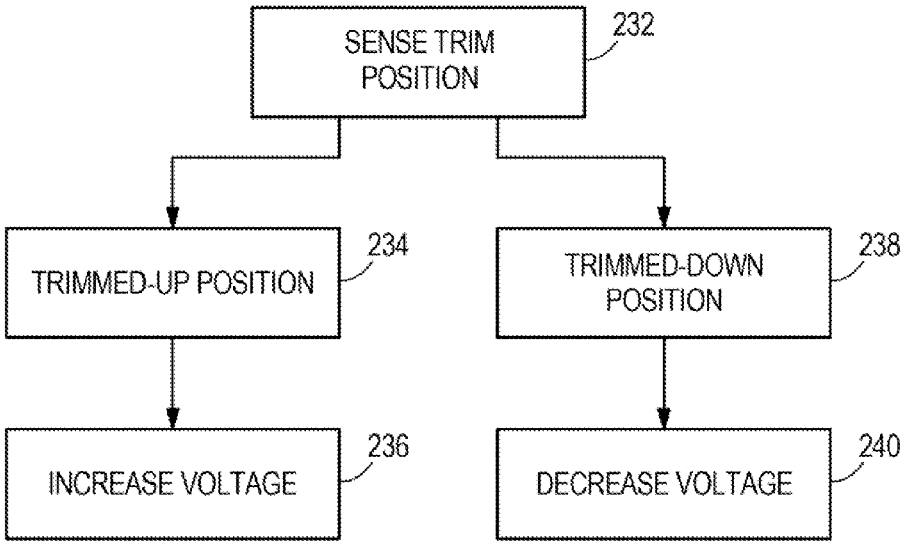

FIG. 10 depicts an example where at step 232, the trim position sensor 104 is configured to sense the trim position of the marine propulsion device 10. At step 234, a trimmed up position is detected and at step 236, the engine control unit 102 is configured to increase the amount of voltage. At step 238, the trimmed down position of the marine propulsion device 10 is detected and at step 240, the engine control unit 102 is configured to decrease the amount of voltage.

Figure 11:
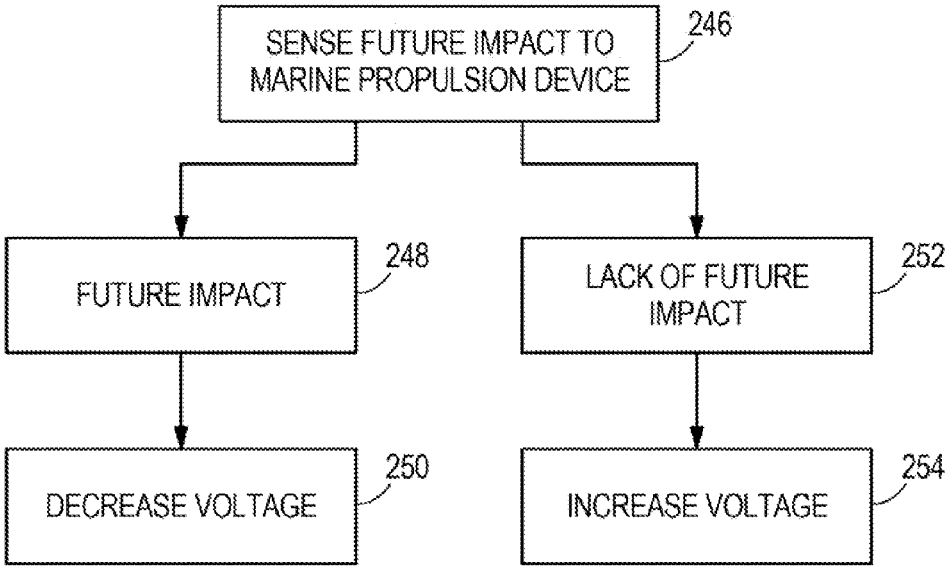

FIG. 11 depicts an example wherein, at step 246, the underwater impact sensor 108 senses a potential impact to the marine propulsion device. If the impact is sensed, at step 248, the engine control unit 102 is configured to decrease the amount of voltage, at step 250. If a lack of future impact is sensed, at step 252, the engine control unit 102 is configured to increase the amount of voltage at step 254.

Figure 12:
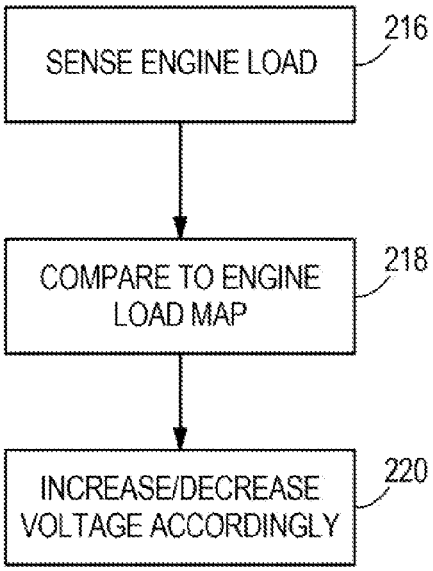

FIG. 12 depicts an example wherein, at step 216, the engine load sensor 110 senses the engine load of the internal combustion engine 16. At step 218, the engine control unit 102 compares the sensed engine load to the noted map or other protocol. At step 220, the engine control unit 102 is configured to increase or decrease the amount of voltage according to the protocol and/or map.

In certain examples, the system 100 can thus provide closed loop feedback from pressure sensors within each piston-cylinder 30 to adjust fluid viscosity and corresponding blow-off pressure for the system. Real time inputs from the engine control unit 102 on engine operation and outboard position can be provided to adjust for improved underwater strike energy absorption or for additional reverse thrust authority. The system 100 can be programmed to output a trim malfunction for operator inspection, service or replacement. The system 100 can be programmed to output a signal to warn the operator of an underwater strike or excessive trim pressures or for data storage for documentation in a warranty claim. This data could also force the marine propulsion devices 10 to reduce power after extended periods of high loads to prevent premature wear-out or durability issues.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A system for controlling trim position of a marine propulsion device on a marine vessel, the system comprising:

a trim actuator having a first end that is configured to couple to the marine propulsion device and a second end that is configured to couple to the marine vessel, the trim actuator being movable between an extended position wherein the marine propulsion device is trimmed up with respect to the marine vessel and a retracted position wherein the marine propulsion device is trimmed down with respect to the marine vessel;

an electromagnet, wherein increasing an amount of voltage to the electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitating easier movement of the trim actuator into and out of the extended and retracted positions;

a controller that is configured to adapt the amount of voltage to the electromagnet based upon at least one condition of the system.

2. The system according to claim 1, wherein the controller comprises a memory that stores a map that correlates the condition of the system to a respective amount of voltage, and wherein the controller adapts the amount of voltage according to the map.

3. The system according to claim 1, wherein the condition of the system comprises the age of the trim actuator.

4. The system according to claim 1, further comprising a pressure sensor that is configured to sense pressure of the magnetic fluid in the trim actuator, wherein the condition of the system comprises the pressure of the magnetic fluid in the trim actuator.

5. The system according to claim 4, wherein the controller is configured to reduce the amount of voltage when the pressure of the magnetic fluid exceeds a pressure threshold.

6. The system according to claim 1, further comprising a shift position sensor that is configured to sense a current gear state of the propulsion device, wherein the condition of the system comprises the current gear state of the propulsion device.

7. The system according to claim 6, wherein the controller is configured to reduce the amount of voltage if the current gear state is a forward gear and wherein the controller is configured to increase the amount of voltage if the current gear state is a reverse gear.

8. The system according to claim 1, further comprising a trim position sensor that is configured to sense a current trim position of the propulsion device, wherein the condition of the system comprises the current trim position of the propulsion device.

9. The system according to claim 8, wherein the controller is configured to increase the amount of voltage when the current trim position of the propulsion device exceeds a trim position threshold.

10. The system according to claim 1, further comprising an underwater impact sensor configured to sense a future impact to the propulsion device, wherein the condition of the system comprises a future impact to the propulsion device and wherein the controller is configured to reduce the amount of voltage when the underwater impact sensor senses a future impact to the propulsion device.

11. The system according to claim 1, further comprising an engine load sensor that is configured to sense a current engine load of the propulsion device, wherein the condition of the system comprises the current engine load of the propulsion device.

12. The system according to claim 1, further comprising an engine speed sensor that is configured to sense a current engine speed of the propulsion device, wherein the condition of the system comprises the current engine speed of the propulsion device.

13. The system according to claim 1, further comprising a steering angle sensor that is configured to sense a current steering angle of the propulsion device, wherein condition of the system comprises the current steering angle of the propulsion device.

14. The system according to claim 1, further comprising a display device, wherein the controller is configured to control the display to display a condition of the trim actuator to an operator.

15. The system according to claim 1, wherein the trim actuator is a hydraulic actuator and further comprising a source of pressurized magnetic fluid that supplies the pressurized magnetic fluid to the hydraulic actuator, wherein the hydraulic actuator further comprises a cylinder, a piston that reciprocates back and forth in the cylinder, and a rod that is coupled to the piston and extends from the cylinder, and further comprising a first inlet to the cylinder on a rod-side of the piston, a second inlet to the cylinder on a cylinder-side of the piston, and a valve that controls flow of the magnetic fluid to the rod-side of the piston and cylinder-side of the piston, wherein flow of magnetic fluid to the rod-side of the piston causes the piston to move such that the piston rod further retracts into the cylinder and wherein flow of magnetic fluid to the cylinder-side of the piston causes the piston to move such that the piston rod further extends from the cylinder.

16. The system according to claim 15, further comprising at least one passage past the piston, wherein the at least one passage conveys magnetic fluid past the piston as the trim actuator is forced by an over pressure event into or out of the extended and retracted positions, wherein increasing the amount of voltage to the electromagnet increases the viscosity of the magnetic fluid and thus restricts flow of the magnetic fluid past the passage in the piston and wherein decreasing the amount of voltage to the electromagnet decreases the viscosity of the magnetic fluid and thus eases flow of the magnetic fluid past the passage in the piston.

17. The system according to claim 16, wherein the electromagnet is coupled to the piston.

18. The system according to claim 17, wherein the electromagnet comprises at least one passage through which the magnetic fluid flows.

19. The system according to claim 16, wherein the at least one passage through the piston comprises a first passage that conveys the magnetic fluid from the rod-side of the piston to the cylinder-side of the piston and a second passage that conveys the magnetic fluid from the cylinder-side of the piston to the rod-side of the piston.

20. The system according to claim 1, further comprising at least one valve that controls flow of magnetic fluid through the at least one passage.

21. The system according to claim 20, wherein the at least one valve comprises a piezoelectric valve.

22. The system according to claim 20, wherein the at least one valve comprises a first check valve that is disposed in the first passage, the first check valve comprising a ball that is biased into a closed position by a plunger and spring, wherein when the magnetic fluid on the rod-side of the piston has a pressure that is larger than a bias force of the spring, the ball is moved into an open position and flow of magnetic fluid from the rod-side to the cylinder-side of the piston is permitted and wherein when the magnetic fluid on the rod-side of the piston has a pressure that is smaller than the bias force of the spring, the ball is biased by the spring into the closed position.

23. The system according to claim 22, wherein the at least one valve comprises a second check valve that is disposed in the second passage, the second check valve comprising a ball that is biased into a closed position by the pressure of the magnetic fluid on the rod-side, wherein when the magnetic fluid on the cylinder-side of the piston has a pressure that is greater than the pressure of the magnetic fluid on the rod-side of the piston, the ball is biased into an open position and flow of magnetic fluid from the cylinder-side to the rod-side of the piston is permitted, and wherein when the magnetic fluid on the cylinder-side of the piston has a pressure that is less than the pressure of the magnetic fluid on the rod-side of the piston, the ball is biased into the closed position.

24. A method for controlling trim position of a marine propulsion device on a marine vessel, the method comprising:

providing a trim actuator having a first end that is configured to couple to the marine propulsion device and a second end that is configured to couple to the marine vessel, the trim actuator being movable between an extended position wherein the marine propulsion device is trimmed up with respect to the marine vessel and a retracted position wherein the marine propulsion device is trimmed down with respect to the marine vessel;

providing an electromagnet, wherein increasing an amount of voltage to the electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitating easier movement of the trim actuator into and out of the extended and retracted positions; and adapting the amount of voltage to the electromagnet based upon at least one condition of the system.

* * * * *